US009443706B2

(12) United States Patent
Gilbert et al.

(10) Patent No.: US 9,443,706 B2
(45) Date of Patent: Sep. 13, 2016

(54) METHOD AND APPARATUS FOR GENERATING SPECTRAL DATA

(75) Inventors: Anthony Gilbert, High Peak (GB); Richard Moulds, Stockport (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 14/128,971

(22) PCT Filed: Jun. 22, 2012

(86) PCT No.: PCT/GB2012/051449

§ 371 (c)(1),
(2), (4) Date: May 5, 2014

(87) PCT Pub. No.: WO2012/175978

PCT Pub. Date: Dec. 27, 2012

(65) Prior Publication Data

US 2014/0246576 A1 Sep. 4, 2014

Related U.S. Application Data

(60) Provisional application No. 61/502,962, filed on Jun. 30, 2011, provisional application No. 61/502,968, filed on Jun. 30, 2011, provisional application No. 61/502,964, filed on Jun. 30, 2011.

(30) Foreign Application Priority Data

Jun. 24, 2011 (GB) ..... 1110720.8
Jun. 24, 2011 (GB) ..... 1110734.9
Jun. 24, 2011 (GB) ..... 1110739.8

(51) Int. Cl.
*H01J 49/00* (2006.01)
*H01J 49/42* (2006.01)

(52) U.S. Cl.
CPC ..... *H01J 49/0036* (2013.01); *H01J 49/0031* (2013.01); *H01J 49/429* (2013.01)

(58) Field of Classification Search
CPC .. H01J 49/429; H01J 49/0063; H01J 49/427; H01J 49/0031; H01J 49/4275; H01J 49/4285; H01J 49/0036; H01J 49/0045
USPC ..... 250/282, 288, 290, 293
See application file for complete search history.

(56) References Cited

U.S. PATENT DOCUMENTS 5,128,542 A 7/1992 Yates et al.
6,410,913 B1 * 6/2002 Brekenfeld ..... H01J 49/424 250/282
7,541,575 B2 * 6/2009 Lock ..... H01J 49/005 250/281
8,164,053 B2 * 4/2012 Sugiyama ..... H01J 49/0045 250/281
8,178,835 B2 * 5/2012 Remes ..... H01J 49/005 250/282
8,735,807 B2 * 5/2014 Mitchell ..... H01J 49/429 250/282
8,748,809 B2 * 6/2014 Zabrouskov ..... H01J 49/0045 250/281

(Continued)

FOREIGN PATENT DOCUMENTS

JP 2008281469 11/2008

*Primary Examiner* — Wyatt Stoffa
(74) *Attorney, Agent, or Firm* — Diederiks & Whitelaw, PLC

(57) ABSTRACT

A method of generating spectral data comprising the steps of deriving a temporally separated sample from a temporal separation device and subjecting the temporally separated sample to an analysis involving scanning at least one spectrally significant parameter, wherein the analysis is performed so that at least two scans in succession are in opposite directions.

18 Claims, 5 Drawing Sheets

(56) References Cited

U.S. PATENT DOCUMENTS

2005/0029448 A1* 2/2005 Chang ..... G01N 21/6402 250/292
2007/0075239 A1* 4/2007 Ding ..... H01J 49/429 250/282
2007/0164208 A1* 7/2007 Quarmby ..... H01J 49/427 250/282
2008/0067350 A1* 3/2008 Li ..... G01N 27/624 250/287
2008/0111070 A1* 5/2008 Makarov ..... H01J 49/004 250/290
2008/0135746 A1* 6/2008 Wildgoose ..... H01J 49/005 250/283
2008/0142705 A1* 6/2008 Schwartz ..... H01J 49/0045 250/292
2008/0302958 A1* 12/2008 Green ..... H01J 49/427 250/282
2009/0032697 A1* 2/2009 Sugiyama ..... H01J 49/0045 250/282
2009/0173877 A1* 7/2009 Bateman ..... G01N 27/622 250/282
2009/0189070 A1* 7/2009 Clemmer ..... G01N 27/622 250/282
2010/0065733 A1* 3/2010 Bateman ..... H01J 49/004 250/282
2010/0065737 A1* 3/2010 Bateman ..... H01J 49/062 250/283
2010/0084552 A1* 4/2010 Kawana ..... H01J 49/0077 250/288
2010/0108878 A1* 5/2010 Bateman et al. ..... 250/283
2010/0237237 A1* 9/2010 Green ..... H01J 49/004 250/283
2011/0101214 A1* 5/2011 Miller ..... G01N 27/624 250/282
2011/0101221 A1* 5/2011 Mukaibatake ..... H01J 49/4215 250/292
2011/0284740 A1* 11/2011 Okumura ..... H01J 49/0045 250/288
2011/0315866 A1* 12/2011 Mitchell ..... H01J 49/429 250/282
2012/0326020 A1* 12/2012 Ivashin ..... G01N 27/622 250/282
2013/0105682 A1* 5/2013 Geromanos ..... H01J 49/005 250/282
2013/0124102 A1* 5/2013 Tate ..... G06F 17/00 702/22
2013/0292562 A1* 11/2013 Clemmer ..... G01N 27/622 250/282
2013/0297230 A1* 11/2013 Kawase ..... G06F 19/703 702/32
2014/0005970 A1* 1/2014 Richardson ..... H01J 49/0036 702/104
2014/0183347 A1* 7/2014 Makarov ..... H01J 49/004 250/252.1
2014/0300369 A1* 10/2014 Hart ..... G01N 27/624 324/470
2014/0346345 A1* 11/2014 Makarov ..... H01J 49/0031 250/283
2015/0034815 A1* 2/2015 Bonner ..... H01J 49/0027 250/282

* cited by examiner

METHOD AND APPARATUS FOR GENERATING SPECTRAL DATA

CROSS REFERENCE TO RELATED APPLICATIONS

This application is the National Stage of International Application No. PCT/GB2012/051449, filed 22 Jun. 2012, which claims priority from and the benefit of U.S. Provisional Patent Application Ser. No. 61/502,962 filed on 30 Jun. 2011, U.S. Provisional Patent Application Ser. No. 61/502,968 filed on 30 Jun. 2011, U.S. Provisional Patent Application Ser. No. 61/502,964 filed on 30 Jun. 2011, United Kingdom Patent Application No. 1110720.8 filed on 24 Jun. 2011, United Kingdom Patent Application No. 1110734.9 filed on 24 Jun. 2011 and United Kingdom Patent Application No. 1110739.8 filed on 24 Jun. 2011. The entire contents of these applications are incorporated herein by reference.

BACKGROUND OF THE INVENTION

This invention relates generally to methods and apparatus for generating spectral data, for example analytical instruments, e.g. mass spectrometers, ultraviolet spectrometers, audio spectrometers and radio frequency spectrometers. More specifically, although not exclusively, this invention relates to such a method and apparatus in which an analysis is carried out involving scanning one or more parameters to generate the spectral data.

It is known, particularly in mass spectrometry, that scanning a parameter whilst generating spectral data from a sample can provide spectral data that permits users to more readily and/or accurately analyse the sample.

For example, some types of mass spectrometers employ scanning techniques to generate a mass spectrum by varying one or more parameters of the electric and/or magnetic field from a start value to a stop value in order to select ions sequentially of different mass to charge ratios (m/z). At the end of the scan, the fields (and other parameters) are reset to their start value and the process is repeated. Other parameters of the mass spectrometer may be varied at the same time in order to optimise aspects of performance.

One disadvantage of this method is that the fields and other parameters take a finite time to settle at the start value, and this settling time reduces the duty cycle of the mass spectrometer. The settling time is generally constant for a given step function, so as the performance of spectrometers is improved to provide faster scan cycle times, the settling time becomes more significant since its contribution becomes a greater proportion of the total time.

Faster scan cycle times are required, for example where mass spectrometers are connected to chromatographic systems (e.g. gas or liquid chromatographs or ion mobility separation device or a field asymmetric ion mobility separation device). There is a continuing evolution of such systems to produce narrower sample peaks in an attempt to reduce analysis times. This requires the mass spectrometer to scan faster in order to provide sufficient spectra to characterise the peak, thus leading to reduced duty cycle (i.e. the ratio of spectral scanning time to settling time).

Another disadvantage is that when insufficient time is allowed for the system to settle, the start of a scan can be contaminated from ions transmitted during the reset time. This may result in an incorrect spectrum.

A further disadvantage is that as a chromatographic peak elutes the ion flux can vary rapidly with time. On the leading edge of a peak the ions are increasing in intensity, and those close to the stop value will be recorded at higher intensity relative to those close to the start value. The reverse is true for the trailing edge of the peak. This effect is sometimes referred to as 'spectral skew', and can impede identification of the spectrum. The spectral skew can be reduced by using faster scan cycles, but this is at the expense of duty cycle as referred to above.

A still further disadvantage becomes apparent when data is viewed in the form of mass chromatograms. Mass chromatograms show the abundance of ions of a particular mass to charge ratio (or range of ratios). All ions belonging to the spectrum of a particular substance will elute with the same temporal profile, and maximise at the same time. Any ion not eluting with the same temporal profile can be assumed to belong to a different substance. This can help to resolve data that is confused due to overlapping profiles.

Scanning mass spectrometers record spectra at discrete time intervals, and different spectral points (e.g. m/z values) within the same spectrum are assigned the same time, whereas they are actually sampled at different times during the scan. This can cause mass chromatograms to appear temporally shifted, making it more difficult to relate spectra with substances. It is possible, with sufficient knowledge of the sampling conditions, to perform calculations to compensate for this distortion, but this adds complexity, and it is not always the case that this knowledge is available. The effect can be mitigated by using faster scan cycles, but this is at the expense of duty cycle as referred to above.

Mass Spectrometers (with scanning analysers or otherwise) which scan or step any parameter that alters the spectral amplitude will also suffer spectral skewing in a similar manner to that described above.

For example, FIG. 5 of the drawings shows a mass spectrometer that can vary the fragmentation energy with respect to time. In the example data (labelled 10) low energy generates predominately high m/z ions, and high energy (labelled 11) generates predominately low m/z ions. Sweeping the energy can be done so that both low and high energy m/z ions are produced efficiently. However, as in the case of a scanning mass analyser, the fragment ratios will be skewed during the rising and falling of a chromatographic peak (as shown in the spectra labelled 12 and 13).

It is therefore a first non-exclusive object of the invention to provide a method and apparatus that addresses or at least mitigates the issues associated with scanning parameters, particularly spectrally significant parameters, in spectrometers. It is a more general non-exclusive object of the invention to provide a method and apparatus configured to generate improved spectral data.

For the avoidance of doubt, the term spectrally significant as referred to herein means that the parameter affects the spectral data, for example scanning it should have a noticeable or significant effect on the spectral data. Similarly, a parameter that is spectrally critical as referred to herein means that scanning it has a substantial effect on the spectral data.

The present invention provides a method, control system, apparatus, analytical instrument, computer program element and computer readable medium as claimed.

Accordingly, one embodiment of the present invention provides a method of generating spectral data comprising the steps of deriving a temporally separated sample from a temporal separation device and subjecting the temporally separated sample to an analysis involving scanning at least one spectrally significant parameter, wherein the analysis is performed so that at least two scans in succession are in opposite directions.

Carrying out at least two scans in succession in opposite directions mitigates the aforementioned issues. Advantageously, the at least one parameter affects the spectral data, for example scanning it should have a noticeable or significant effect on the spectral data.

The scanning step may involve scanning the parameter from a start value to an end value and thereafter in the reverse direction from the end value to the start value. Preferably, the analysis includes or involves or consists of scanning alternately in opposite directions. More preferably, the scanning is at least semi-continuous and most preferably the scanning is substantially continuous or even continuous. For example, at the end of the or a scan, e.g. a first scan, in one direction, e.g. a first direction, the parameter may be re-scanned, e.g. the parameter may be subjected to a second scan, which re-scan or second scan may be in the other direction, e.g. a second direction, which may be opposite the first direction. In one preferred embodiment, the parameter is subjected to a first scan in a first direction followed, e.g. followed immediately, by a second scan in a second direction opposite the first direction.

Some changes in operating conditions may be necessary as appropriate to scanning in the other direction, but these will require much less settling time than that required in the case where, e.g. the parameter is reset to the original scan start. The effect is that the reset time between scans may be substantially reduced. A compound spectrum or spectra or set or series of spectra or compound spectra can be constructed or produced from a combination of successive scans, e.g. a pair of scans, in opposite directions, e.g. the method may include or involve producing a single spectrum from the combination of successive scans in opposite directions; this compound spectrum is likely to exhibit much reduced distortion resulting from spectral skew.

The at least one parameter may be or comprise an electrical and/or magnetic field, e.g. for scanning ion mass in a mass spectrometer, and/or mass and/or mass to charge ratio and/or light desorbtion frequency and/or rate of change of ion mobility. Other spectrally significant elements might include sample cone, source fragmentation lens or differential aperture, collision energy and/or RF amplitude of ion guides.

The analysis may be carried out using an analytical apparatus or instrument such as a spectrometer, e.g. a mass spectrometer, ultraviolet spectrometer, acoustic spectrometer, radio frequency spectrometer or any other apparatus or instrument for generating spectra data.

The temporal separation may involve, for example, liquid chromatography and/or gas chromatography and/or supercritical fluid chromatography and/or capillary electrophoresis and/or ion mobility spectrometry and/or field asymmetric ion mobility spectrometry and/or sampling from a reaction vessel and/or time of flight separation.

When performed using a mass spectrometer, the scanning step may involve scanning a parameter, for example a spectrally significant parameter, e.g. from a start mass and/or m/z dependent and/or optimised value to an and mass and/or m/z dependent and/or optimised value and thereafter in the reverse direction from the end mass and/or m/z dependent and/or optimised value to the start mass and/or m/z dependent and/or optimised value.

Preferably, the analysis includes or involves or consists of scanning alternately in opposite directions. More preferably, the scanning is at least semi-continuous and most preferably the scanning is substantially continuous or even continuous. For example, at the end of the or a scan, e.g. a first scan, in one direction, e.g. a first direction, a parameter may be re-scanned, e.g. the parameter may be subjected to a second scan, which re-scan or second scan may be in the other direction, e.g. a second direction, which may be opposite the first direction. In one preferred embodiment, the parameter is subjected to a first scan in a first direction followed, e.g. followed immediately, by a second scan in a second direction opposite the first direction.

Where the analysis is carried out using a spectrometer, the scanning step may comprise or further comprise scanning one or more parameters of an electrical and/or magnetic field and/or mass to charge ratio and/or wavelength and/or energy and/or frequency and/or a physical element such as a reflector or refracting element such as by movement or rotation thereof, e.g. alternating and/or rotary movement thereof. The method may further comprise forming ions in an ion source and may include one or more of the following steps: causing the ions to enter a mass analyser; selecting ions sequentially according to their mass to charge ratio, e.g. by scanning one or more parameters of an applied electrical and/or magnetic field from a start mass and/or m/z dependent and/or optimised value to an end mass and/or m/z dependent and/or optimised value; scanning one or more, e.g. the one or more, parameters of electrical and/or magnetic fields in the opposite direction, e.g. back to the start mass; measuring the current due to selected ions being detected, e.g. by a detector, over a scan in a first direction, e.g. to provide a first mass spectrum; measuring the current due to selected ions being detected over a second scan, e.g. next succeeding scan, which may be in the opposite direction, e.g. to the first scan, to provide a second mass spectrum, Ions generated in the ion source may be accumulated and/or stored, e.g. over a period of time, in an ion storage device, e.g. for analysis, e.g. later analysis, by the mass analyser and, optionally, subsequent detection by the detector. The accumulation and/or storage of the ions may be after the scanning step and/or prior to being released into the mass analyser. Ions may be prevented from entering the mass analyser, e.g. they may be accumulated in the storage device in order to reduce spectral skewing.

The current may be measured over the forward portion of a scan, e.g. to provide a forward mass spectrum, and may further be measured thereafter over the reverse portion of that scan, e.g. to provide a reverse mass spectrum.

The method may further comprise deriving a temporally separated sample, e.g. from a temporal separation device, and/or subjecting the temporally separated sample to a mass spectrometric analysis. The temporal separation may involve, for example, liquid chromatography and/or gas chromatography and/or supercritical fluid chromatography and/or capillary electrophoresis and/or ion mobility separation and/or field asymmetric ion mobility separation and/or sampling from a reaction vessel and/or time of flight separation Another embodiment of the invention provides an apparatus for generating spectral data, the apparatus comprising a temporal separation device for deriving a temporally separated sample and an analyser For subjecting the temporally separated sample to a scanning analysis, wherein the apparatus or analyser is configured or adapted or operable or programmed to scan at least one parameter such that at least two scans in succession are in opposite directions.

Another embodiment of the invention provides an analytical instrument comprising a mass spectrometer having an ion source, a mass analyser and a detector, wherein the analytical instrument is configured or adapted or operable or programmed to scan the mass analyser so that at least two scans in succession are in opposite directions.

Advantageously, the apparatus, analytical instrument, or analyser may be configured or adapted or operable or programmed to carry out one or more of the method steps of the method according to the first embodiment of the invention.

For example, the apparatus or analyser may be configured or adapted or operable or programmed to scan alternately in opposite directions. Preferably, the apparatus or analyser is configured or adapted or operable or programmed to conduct a scanning analysis that consists of scanning alternately in opposite directions. Preferably, the apparatus or analyser is configured or adapted or operable to conduct the scanning analysis at least semi-continuously, e.g. substantially continuously.

The apparatus is preferably an analytical apparatus or instrument, more preferably a spectrometer, for example a mass spectrometer. Additionally or alternatively, the analytical apparatus or instrument may comprise any apparatus for generating spectral data including but not limited to mass spectrometers, ultraviolet spectrometers, audio spectrometers and radio frequency spectrometers.

The analytical instrument may comprise a spectrometer, for example a mass spectrometer. The mass spectrometer may include an ion source and/or a mass analyser and/or a detector and/or an analyser control system, which analyser control system may be configured or adapted or operable or programmed to scan the mass analyser so that at least two scans in succession are in opposite directions.

The temporal separation device may include, for example a liquid chromatograph and/or a gas chromatograph and/or a supercritical fluid chromatograph and/or a capillary electrophoresis system and/or an ion mobility separator, e.g. including a fixed asymmetric ion mobility separator and/or a time of flight separator.

The analyser may include scanning elements and/or may comprise:

A time-of-flight mass analyser,
A quadrupole mass analyser,
A magnetic sector mass analyser,
A 2D or 3D ion trap mass analyser,
An ion cyclotron resonance mass analyser,
A Fourier transform mass analyser,
An orbitrap mass analyser,
An infra red analyser,
An ultra violet analyser,
A raman analyser,
A nuclear magnetic resonance analyser,
An X-ray scanner,
An absorbtion analyser,
A plasma emission analyser,
A flow discharge optical emission analyser,
An inductively coupled plasma atomic emission analyser,
A laser induced breakdown analyser,
An audio or acoustic analyser and/or
An optical analyser.

The apparatus may comprise a liquid chromatography (LC)/mass spectrometer (MS) combination, e.g. a high performance liquid chromatography (HPLC)/mass spectrometer (MS) combination.

The apparatus may comprise an ion mobility device/mass spectrometer (MS) combination.

Further embodiments of the invention provide a control system configured or adapted or operable or programmed to execute the method, a computer program element comprising computer readable program code means for causing a processor to execute a procedure to implement the method and/or a computer readable medium embodying such a computer program element. A yet further embodiment of the invention provides a computer readable medium having a program stored thereon, where the program is to make a computer execute a procedure to implement the method.

BRIEF DESCRIPTION OF THE DRAWINGS

Embodiments of the invention will now be described by way of example only with reference to the accompanying drawings in which.

DETAILED DESCRIPTION OF THE PREFERRED EMBODIMENTS

Figure 2:
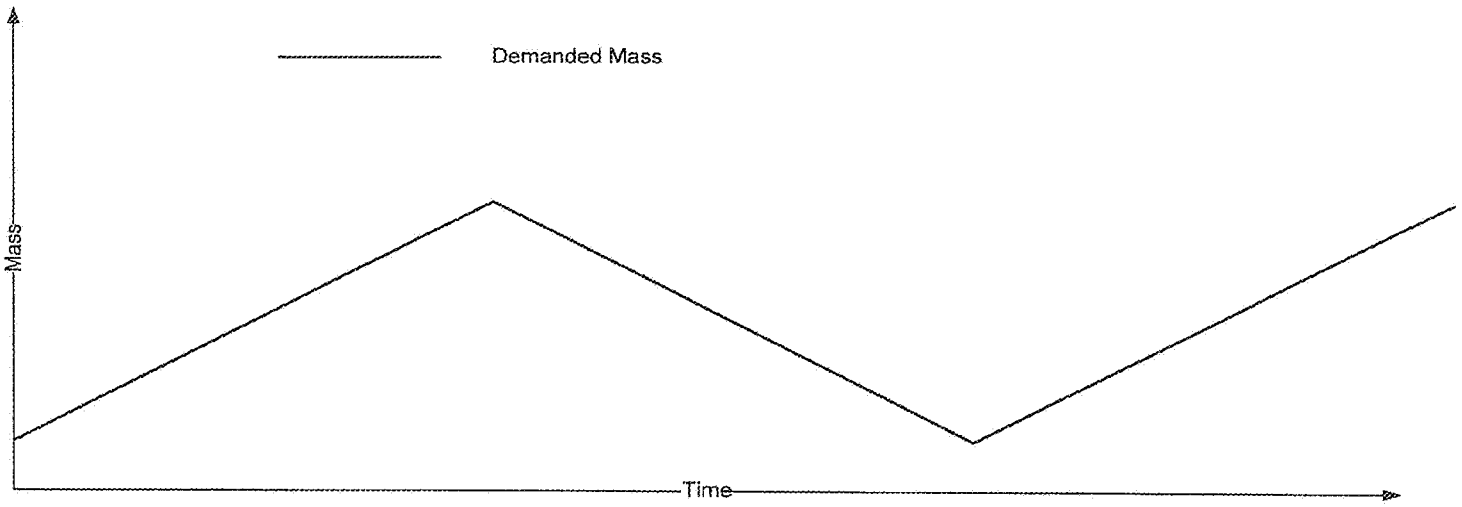
FIG. 2 is a schematic representation of scanning a mass spectrometer according to one embodiment of the present invention.
Figure 3:
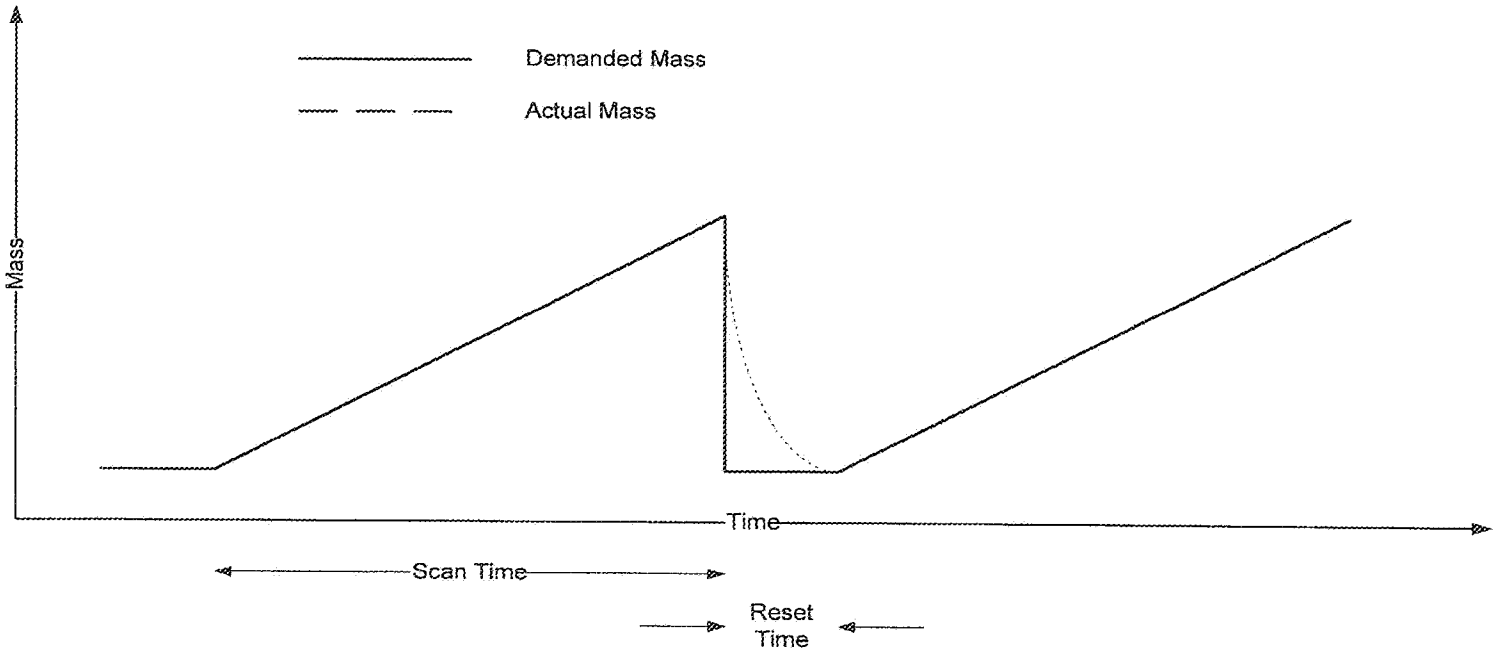
FIG. 3 is a schematic representation of scanning a mass spectrometer according to a prior art scanning method, wherein the dashed line shows reset of the system to the start mass, and the time labelled 'Reset Time' is lost for analysis.
Figure 4:
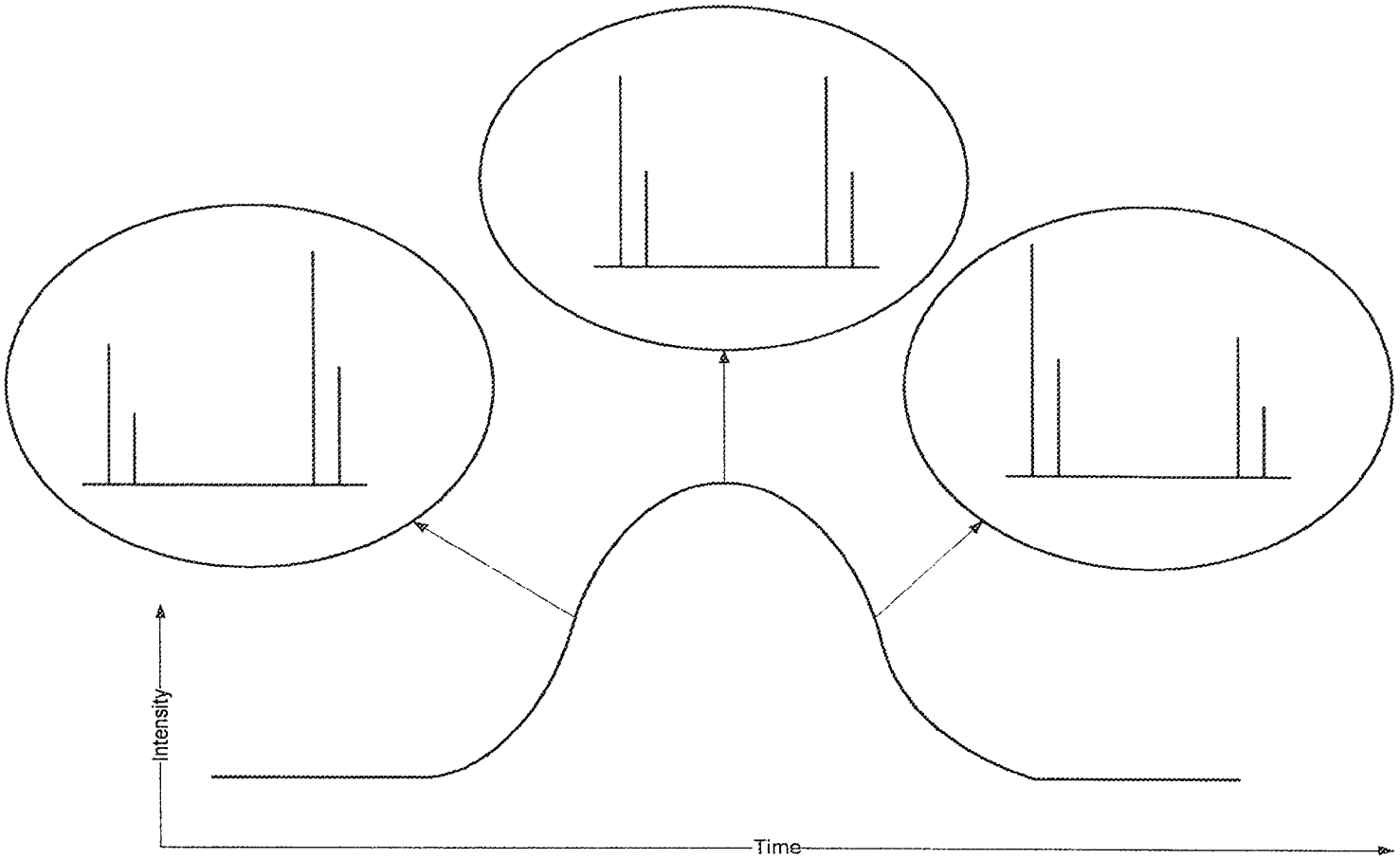
Fig. 4 (Prior Art)
FIG. 4 is a schematic representation (where the scan direction is left to right) of how spectra are skewed depending on their position in an eluting chromatographic peak when acquired on a mass spectrometer using a prior art scanning method, wherein the spectrum acquired on the leading edge has masses closer to the start mass suppressed with respect to masses closer to the end mass, and vice versa for the spectrum acquired on the trailing edge.

A preferred embodiment of the present invention will now be described with reference to FIGS. 1 to 3 of the drawings. A second embodiment of the present invention will be described with reference to FIG. 5.

Figure 1:
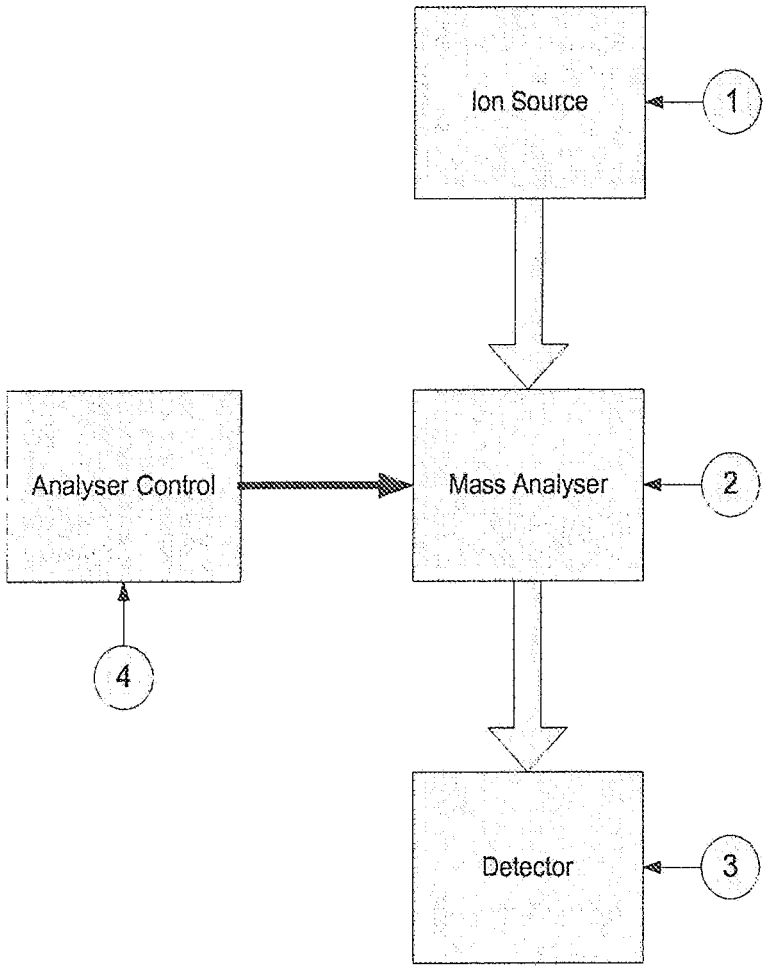
FIG. 1 is a schematic representation of a scanning mass spectrometer.

Referring to FIG. 1, there is shown a scanning mass spectrometer that includes an ion source 1, a mass analyser 2, a detector 3, and an analyser control system 4, whose output scans the mass analyser from a start mass to an end mass.

The mass analyser 2 may be, but is not limited to, quadrupole mass analyser, ion cyclotron resonance mass analyser, ion trap mass analyser or a magnetic sector mass analyser. The mass spectrometer provides mass and charge information, such as the mass-to-charge ratio, in relation to the ions received.

Ions formed in the ion source enter the mass analyser 2 where they are selected according to their mass to charge ratio by means of an electrical and/or magnetic field. Ions of different mass to charge ratios are selected sequentially by varying or scanning the applied electrical or magnetic fields from a start mass to an end mass (the 'forward' portion of the scan). The fields are then scanned in the opposite direction back to the start mass (the 'reverse' portion of the scan. The current due to selected ions arriving at the detector (not shown) is measured over the forward portion of the scan to provide a forward mass spectrum, then over the reverse portion of the scan to provide a reverse mass spectrum. A single mass spectrum is produced from the combination of the forward and reverse spectra.

The above is repeated to generate subsequent mass spectra.

Figure 5:
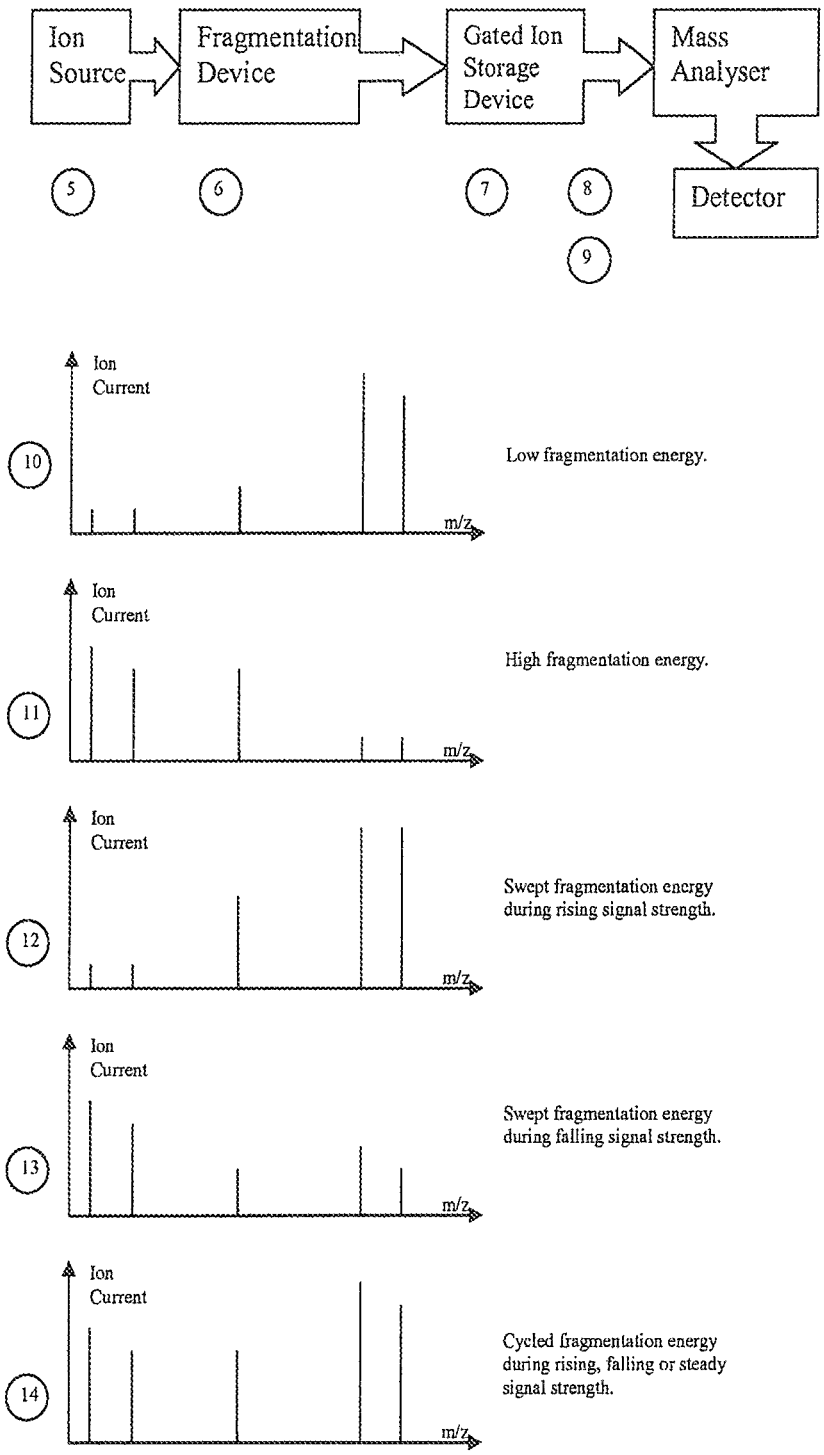
FIG. 5 is a schematic representation of a mass spectrometer with the incoming ion current decoupled from the mass analyser by a gated ion storage mechanism, wherein the mass analyser may not suffer from spectral skew, but since the instrument can scan the ion fragmentation energy, the resultant mass spectra may suffer from spectral skew.

FIG. 5 shows an embodiment of the invention where the scanning of ion fragmentation energy would cause spectral skewing but for the proposed bidirectional scanning of that energy. Ions generated in ion source 5 are fragmented depending upon the energy imparted to them in the fragmentation device 6. Over a period of time the fragmented ions are stored in an ion storage device 7 for later analysis by mass analyser 8 and subsequent detection by the detector 9. Typically, applying a low fragmentation energy results in fragmentation patterns that favour high m/z ions as shown in 10. Conversely, applying a high fragmentation energy results in fragmentation patterns that favour low m/z ions as shown in 11. Maximising the response across the m/z range is often desirable, and for this reason the fragmentation energy may be scanned whilst ions are being accumulated in the storage device. In this embodiment the ions are prevented from entering the mass analyser whilst incoming ions are entering the storage device 7. The mass analyser therefore will not be a cause of spectral skewing. However, it can be seen that scanning the fragmentation energy will cause skewing as shown in spectra 12 and 13. By scanning the fragmentation energy from low to high and back to low again, ions accumulated in the storage device will have reduced spectral skew. Spectra 14 depicts how this effective summing of forward and reverse energy scans results in a fragmentation pattern that is largely independent of where on the chromatographic peak the ion current is sampled.

Preferably, the first and second scans are substantially symmetrical to one another. For example, the rate of change of the spectrally significant parameter when scanning in one direction is the same as the rate of change of the spectrally significant parameter when scanning in the opposition direction.

It will be apparent that various modifications may be made to the particular embodiments discussed above without departing from the scope of the invention.

It will also be appreciated by those skilled in the art that any number of combinations of the aforementioned features and/or those shown in the appended drawings provide clear advantages over the prior art and are therefore within the scope of the invention described herein.

The invention claimed is:

1. A method of generating spectral data, conducted using a temporal separation device and an analyser, comprising the steps of:

providing a temporally separated sample of ions using the temporal separation device; and subjecting the temporally separated sample of ions to an analysis conducted with the analyser, said analysis comprising performing a sweeping or rising or falling scans of at least one spectrally significant parameter, the at least one parameter including a fragmentation energy or collision energy applied to the sample of ions, wherein the scans are performed so that at least two scans in succession are in opposite directions whereby spectral performance is improved.

2. A method according to claim 1, wherein the scans are substantially continuous.

3. A method according to claim 1, wherein the parameter is subjected to a first scan in a first direction followed by a second scan in a second direction opposite the first direction and further comprising constructing a compound spectrum or spectra from the first and second scans.

4. A method according to claim 1, wherein the at least one parameter is spectrally critical.

5. A method of claim 1, comprising generating spectral data from an analytical instrument, wherein the analysis is a mass spectrometric analysis.

6. A method of claim 1, wherein the temporal separation step involves liquid or gas or supercritical fluid chromatography, ion mobility separation, field asymmetric ion mobility separation, time of flight separation, capillary electrophoresis, or sampling from a reaction vessel.

7. A method according to claim 1, wherein the spectral data is generated from a mass spectrometer, the method comprising the step of operating a mass spectrometer having an ion source, a mass analyser and a detector by scanning the mass analyser so that at least two scans of said mass analyser in succession are in opposite directions.

8. A method according to claim 7, wherein said scanning of said mass analyser comprises scanning from a start mass dependent value to an end mass dependent value and thereafter scanning in a reverse direction from the end mass dependent value to the start mass dependent value.

9. A method according to claim 7, wherein the current due to ions arriving at the detector is measured over a forward portion of a scan of said mass analyser to provide a forward mass spectrum and thereafter over a reverse portion of that scan of said mass analyser to provide a reverse mass spectrum.

10. A method according to claim 7, further comprising forming ions in the ion source, causing the ions to enter the mass analyser, selecting ions sequentially according to their mass to charge ratio by scanning one or more parameters of an applied electrical or magnetic field of said mass analyser from a start mass dependent value to an end mass dependent value, scanning the one or more parameters of the electrical or magnetic fields of said mass analyser in the opposite direction back to the start mass dependent value, measuring the current due to selected ions being detected over a scan of said mass analyser in a first direction to provide a first mass spectrum, measuring the current due to selected ions being detected over the next succeeding scan of said mass analyser in the opposite direction to the first scan of said mass analyser to provide a second mass spectrum.

11. A method according to claim 1, wherein the spectral data is generated from a mass spectrometer having an ion source, and wherein ions generated in the ion source are accumulated and stored over a period of time in an ion storage device after the scan step and prior to being released into a mass analyser.

12. A method according to claim 1, further comprising scanning a further parameter that is spectrally significant.

13. A method according to claim 12, wherein the further parameter relates to a sample cone, source fragmentation lens or differential aperture, collision energy or RF amplitude of an ion guide.

14. An apparatus for generating spectral data, the apparatus comprising:

a temporal separation device for providing a temporally separated sample of ions, and an analyser for subjecting the temporally separated sample of ions to an analysis, said analysis comprises performing a sweeping or rising or falling scans of at least one spectrally significant parameter including a fragmentation energy or collision energy applied to the sample of ions, wherein the scans are performed so that at least two scans in succession are in opposite directions whereby spectral performance is improved.

15. An apparatus according to claim 14, wherein the apparatus includes an analytical instrument for subjecting the temporally separated sample to a mass spectrometric analysis.

16. An apparatus according to claim 14, wherein the temporal separation device comprises one or more of a liquid chromatograph, a gas chromatograph, a supercritical fluid chromatograph, a capillary electrophoresis system, an ion mobility separator, a fixed asymmetric ion mobility separator or a time of flight separator.

17. An apparatus according to claim 14, wherein the analyser comprises one or more of a quadrupole mass analyser, a magnetic sector mass analyser, a 2D or 3D ion trap mass analyser, an ion cyclotron resonance mass analyser, an infra red analyser, an ultra violet analyser, a raman analyser, a nuclear, magnetic resonance analyser, an X-ray scanner an absorbtion analyser, a plasma emission analyser, a flow discharge optical emission analyser, an inductively coupled plasma atomic emission analyser, a laser induced breakdown analyser, an audio or acoustic analyser or an optical analyser.

18. An apparatus according claim 15, wherein the analytical instrument comprises an ion mobility device/mass spectrometer combination.

* * * * *